United States Patent [19]

Johnson et al.

[11] Patent Number: 4,535,398

[45] Date of Patent: Aug. 13, 1985

[54] COMBINED LINER LOCKING AND LOCKING WASHER SYSTEM FOR MOUNTING AN INCANDESCENT LAMP

[75] Inventors: George E. Johnson, Bronxville; Stanley Brenner, Massapequa, both of N.Y.

[73] Assignee: Leviton Manufacturing Company, Inc., Little Neck, N.Y.

[21] Appl. No.: 641,902

[22] Filed: Aug. 20, 1984

[51] Int. Cl.[3] ..... F21V 21/14

[52] U.S. Cl. ..... 362/404; 362/382

[58] Field of Search ..... 362/382, 404, 391, 396, 362/403, 433, 440

[56] References Cited

U.S. PATENT DOCUMENTS

| | | | |
|---|---|---|---|
| 801,103 | 10/1905 | Rector | 362/433 |
| 909,447 | 1/1909 | Pearson et al. | 362/433 |
| 1,530,923 | 3/1925 | Anns | 362/382 |
| 1,762,781 | 6/1930 | Jenkins | 362/433 |
| 1,772,930 | 8/1930 | D'Olier, Jr. | 362/404 |
| 1,908,587 | 5/1933 | D'Olier, Jr. | 362/404 |
| 2,118,372 | 5/1938 | Brown | 362/433 |
| 2,229,403 | 1/1941 | Benander | 362/382 |
| 2,561,954 | 7/1951 | Salneu | 362/382 |
| 3,041,035 | 6/1962 | Pascucci | 362/404 |

FOREIGN PATENT DOCUMENTS

| | | | |
|---|---|---|---|
| 1533323 | 7/1968 | France | 362/396 |
| 999358 | 7/1965 | United Kingdom | 362/433 |

*Primary Examiner*—Raymond A. Nelli

*Attorney, Agent, or Firm*—Paul J. Sutton

[57] ABSTRACT

This invention relates to a unitary liner locking and locking washer device that is positioned between the wall mounting fixture and the vertical bracket support for an incandescent lamp. The unitary device includes a ring element having one end having a resilient upwardly disposed finger that is pressed into a biased position between the threaded portions of the fixture and the bracket. The other end of the ring element has a resilient prong having a hooked tip also upwardly disposed. The prong is unbiased with the tip engaged in a slot in the liner to lock the liner in position and can be biased inwardly to free the liner.

8 Claims, 4 Drawing Figures

FIG. 1
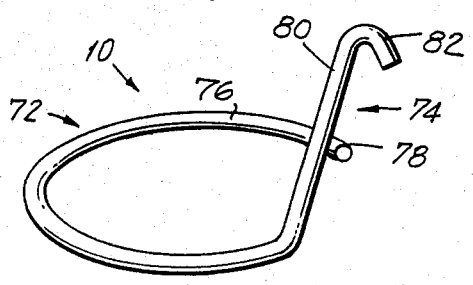
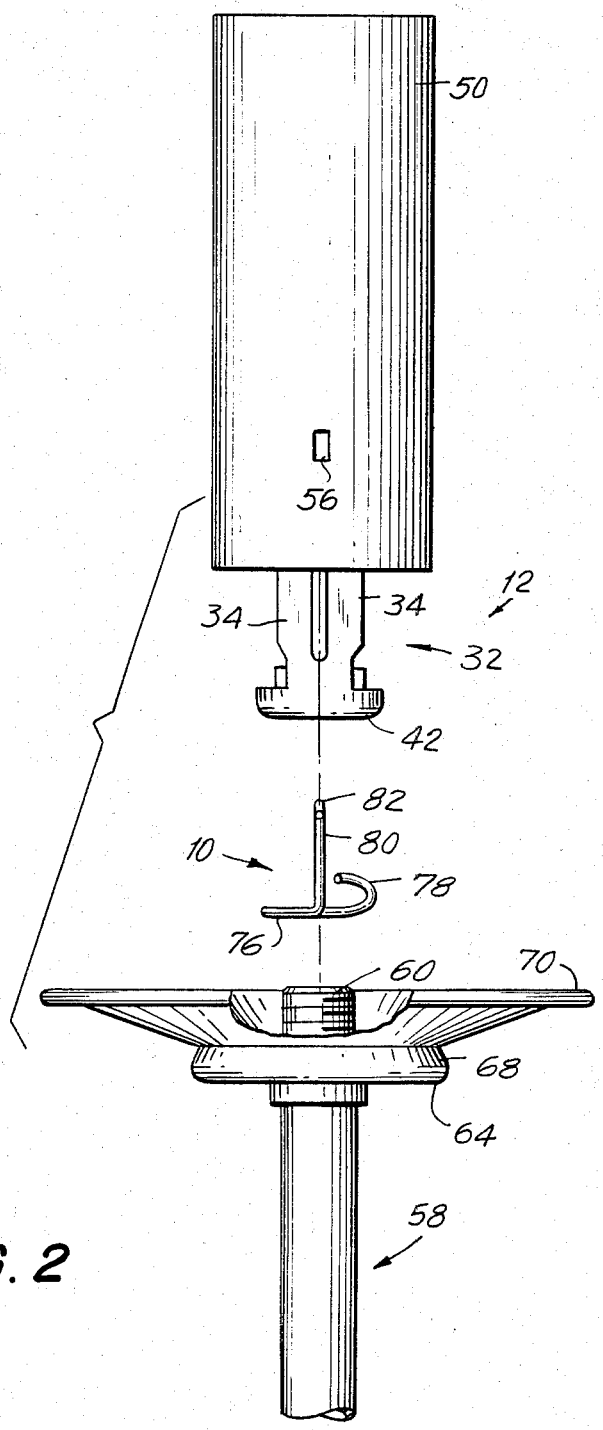
FIG. 2

FIG. 3
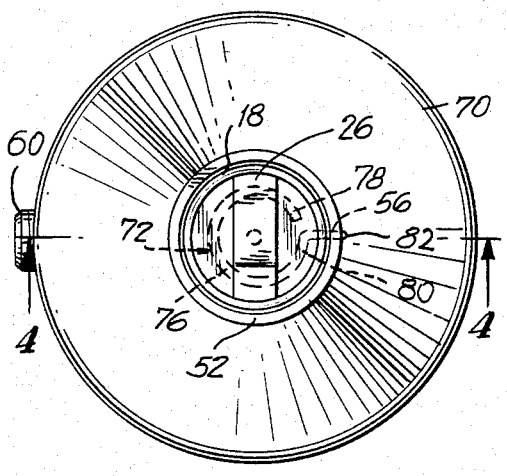
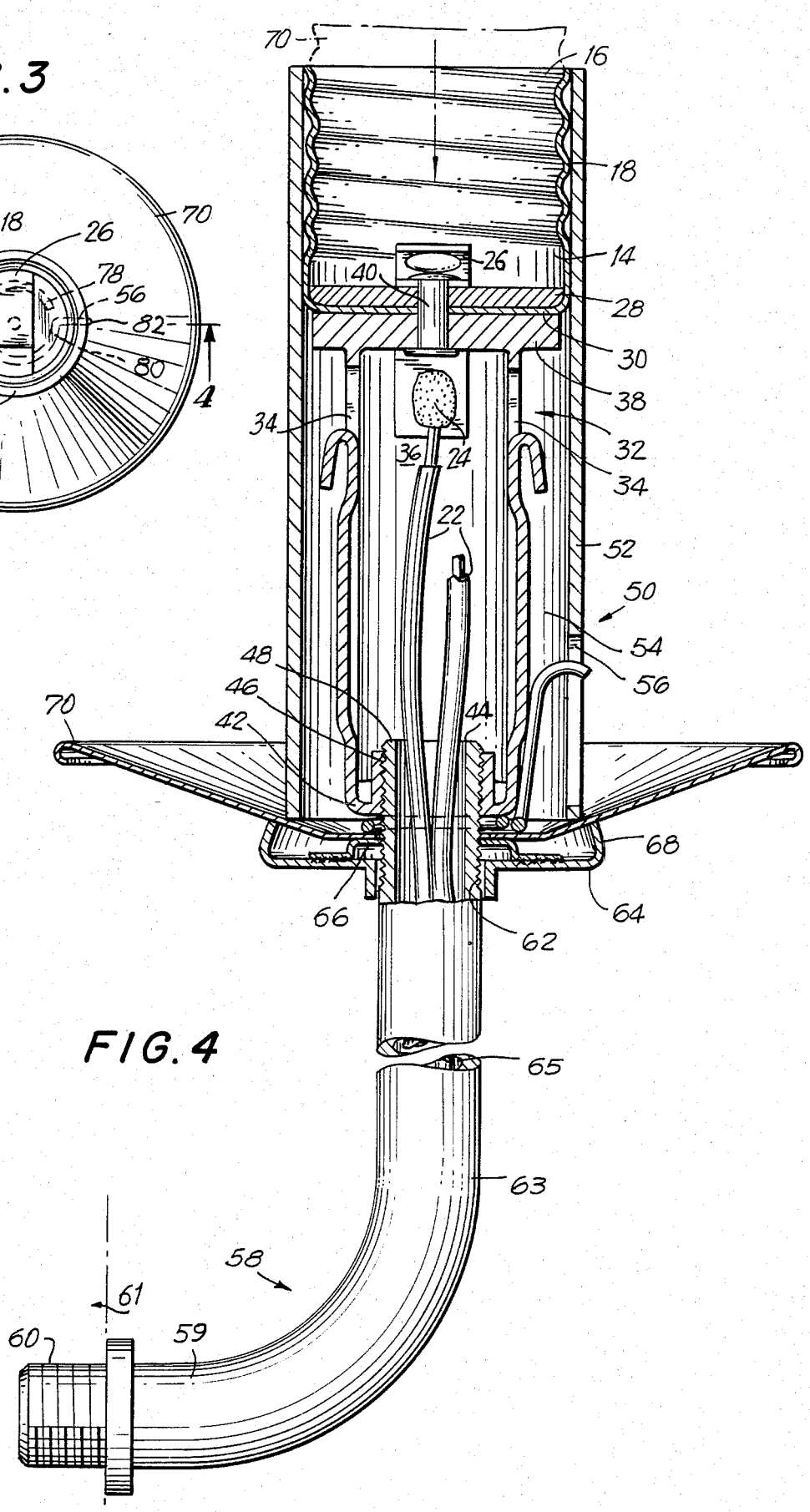
FIG. 4

COMBINED LINER LOCKING AND LOCKING WASHER SYSTEM FOR MOUNTING AN INCANDESCENT LAMP

This invention relates generally in mounting an incandescent lamp and particularly to a unitary liner locking and locking washer device positioned between the wall fixture and the vertical bracket support for an incandescent lamp.

The bracket support for an incandescent lamp must be securely mounted to the wall mounting fixture and at the same time must be easily removable for repairing the mounting portions. Another problem associated with wall-mounted lamps in general is having the protective liner for the elongated, upright bracket securely held around the bracket so that it is not accidently lifted by, for example, a child, so as to expose live wiring or connections under the liner. A simple device that could handle both these problems simultaneously would be advantageous from the standpoints of safety, cost, and ease of assembly or disassembly.

As far as the applicant is aware, there exists no simple device that could both lock the bracket to the wall fixture, and in addition lock the fixture and bracket together by way of a locking washer.

The present invention contemplates a combined system for mounting an incandescent lamp that provides a novel arrangement and construction that provides a double safety feature for the lamp that is both simple to manufacture and to use in the assembly and disassembly of the lamp.

Accordingly, it is an object of this invention to provide a combined liner locking and locking washer system for mounting between the wall fixture portion and the upright bracket portion of the mounting for an incandescent lamp.

It is a further object of this invention to provide a unitary washer and clip device that is positioned between the threaded portions between the wall fixture portion and the upright bracket portion of the mounting for a lamp.

It is yet a further object of the present invention to provide a unitary ring element having an upright resilient finger member combined with a prong element having a hooked tip capable of engaging a slot in the liner of the bracket portion of the mounting.

It is still a further object of the present invention to provide a simple combined locking washer and liner lock that is simple to make, easy to assemble, safe to use, and easy to disassemble.

The present invention fulfills the above objects by providing a liner locking and locking washer system for a mounting for an incandescent lamp that comprises a socket body for holding the incandescent lamp; electrical conductors for connecting the lamp with a source of electrical power; an elongated bracket for holding the socket body at one end and forming a hole provided with internal threads at the opposed end, the bracket means also being for passing the conductors from the socket body through the hole; an elongated liner having a cylindrical wall forming a hollow cylinder adapted to be slidingly positioned around the codket body and the bracket, the outer wall forming a slot proximate to the internal threads of the hole; a fixture for mounting the bracket to a support structure, generally a vertical wall, at one end and having external threads at the other end that are matingly connected to the internal threads of the bracket, the fixture also being for passing the conductors from the bracket to the source of electrical power, the fixture including a stop member positioned proximate to the external threads for preventing the liner from sliding onto the fixture; and a unitary washer and clip device for providing a locking worker between the stop member of the fixture and for interacting with the slot of the liner for removably locking the unitary device. With the liner and thus preventing the liner from sliding away from the fixture while in a locked mode. The unitary device includes a ring portion and a clip portion, with the ring portion being positioned around the external threads of the fixture in abutting relationship with the stop member and in pressing connection with the opposed end of the bracket. The unitary device is made of a resilient material and includes a ring element having proximately spaced end portions one of which has a resilient finger and the other of which has a resilient prong having a hooked top disposed towards the fixture. Both the prong and the finger are disposed upwardly, that is, towards the socket body. The finger is movable between an unbiased position or mode spaced from the plane of the ring element and a biased position substantially aligned with the plane of the ring element. The finger is pressed into a biased mode by the opposed end of the bracket being threaded upon the threads of the fixture. The prong is movable between an unbiased position wherein the hooked tip is capable of extending past the outer surface of the liner wall and a biased position wherein the hooked top is positioned with the inner surface of the liner wall. The slot of the liner is capable of receiving the hooked top in locked relationship there between in the unbiased position in the locked mode. The hooked tip is capable of being pressed from the slot into the biased position into an unlocked mode, whereby the liner can be manually placed around or removed from the bracket and the socket body.

The invention will be more clearly understood from the following description of specific embodiments of the invention together with the accompanying drawings wherein similar reference characters denote similar elements throughout the several views, and in which:

FIG. 1 is an isometric view of the combined liner locking and washer device according to the present invention;

FIG. 2 is an explodes side view showing the combined device positioned ready for assembly with an elongated mounting bracket holding a socket body and a mounting fixture;

FIG. 3 is a top view of the assembled mounting bracket and mounting fixture with the combined device in position; and FIG. 4 is a sectional side view taken through line 4—4 of FIG. 3.

Reference is now made in detail to the drawings, wherein reference numerals are correlated to various elements of the invention as described below.

FIG. 1 shows an isometric illustration of the combined liner lock clip and locking worker device 10, which is shown in side view in the exploded illustration of FIG. 2. The combined liner lock and locker washer device 10 is shown as an element in the liner locking and locking washer system 12 in FIG. 2 immediately prior to assembly of system 12. FIGS. 3 and 4 show system 12 as assembled. With reference to FIGS. 3 and 4, a cylindrical socket body 14 forming a cylindrical socket 16 that has mounted within it a threaded shell 18 that is capable of receiving in threaded relationship a shell body of an incandescent lamp 20, shown in phantom lines. FIG. 4 also shows a pair of electrical conductors 22 that connect shell 18 of socket body 14 with a source of electrical power(not shown). Conductors 22 are connected to a pair of electrical connectors 24(one of which is shown in FIG. 4) to spring contact 26 and shell 18 which electrically connect conductors 22 to the base shell of incandescent lamp 20. An inner insulation pad 28 is shown situated bwtween base 30 of socket body 14 and shell 18.

An elongated mounting bracket 32 has a pair of elongated opposed brace members 34 that form an elongated passageway 36 between them to accomodate passage of conductors 22. One end of bracket 32 has a cylindrical insulated support member 38 secured to the end portions of brace members 34 with member 38 in turn secured to base 30 of socket body 14 preferably by a central rivet 40. The opposed end of bracket 32 forms a cross-brace, or shoulder, 42 that extends transversely between the ends of brace members 34. A hole 44 lateral to the elongated disposition of brace members 34 is formed by shoulder 44. Internal threads 46 are formed around the surface of hole 44. Conductors 22 pass through passageway 36 and hole 44. As seen in FIG. 2 hole 44 is formed in part by a cylindrical flange 48 that extends into passageway 36. Flange 48 gives depth to hole 44 for formation of internal threads 46.

An elongated insulation liner 50 made of an electrically non-conductive material includes a cylindrical wall 52 forming a hollow cylinder 54. Liner 50 is adapted to be slidingly positioned around socket body 14 and elongated bracket 32, with wall 52 being in slidingly snug relationship with socket body 14 when positioned in place as shown in FIGS. 3 and 4 so that liner 50 does not rock at the socket body portion. Wall 52 forms a slot 56 that is lateral to the elongated direction of brace members 34. Slot 56 is positioned spaced clearly to, or proximate to, internal threads 46 of bracket 32 when liner 50 is mounted in position around bracket 32 and socket body 14.

An elongated mounting fixture 58 is adapted to be mounted to a support structure such as a vertical wall 61 at one end by way of connecting external threads 60 provided around the circular surface of fixture 58. External threads are illustrated but the fastening means may be of other types known in the art. Fixture 58 is a tubular member having a hollow interior 65 adapted to pass conductors 22 from hole 44 of bracket 32 to the source of electrical power. Fixture 58 is shown as having a horizontal portion 59 extending from vertical support structure 61 and a vertical portion 63 that bends upwardly so as to support a vertically oriented bracket 32 and socket body 14, but it may also extend horizontally when used for certain purposes. The other end of fixture 58 from connecting threads 60 is provided with external threads 62 that are mated to receive internal threads 46 of bracket 32. FIG. 4 shows external and internal threads 62 and 46 threaded together so as to join bracket 32 with fixture 58. Fixture 58 is provided with a stop member 64 that is a flat, transversely disposed cylindrical member that is secured to the outer surface of fixture 58 adjacent to external threads 62 by a locking washer 66 provided with a pair of opposed flanges adapted to screw onto external threads 62 so as to effectively bond stop member 64 to fixture 58. A circumferential lip 68 extends upwardly toward bracket 32 so as to form a pocket with the generally transverse wall of stop member 64. As seen in FIGS. 3 and 4, a slightly disked ornamental wax-dripping catcher 70 having a circular aperature adapted to fit around the tubular externally threaded portion 62 of fixture 58 can optionally be set between bracket 32 and fixture 58 with the hollow portion of the disk of ornamental wax-dripping catcher 70 oriented upwardly so that the wedged portion of catcher 70 is set in the pocket of stop member 64 formed by circumferential lip 68.

Combined liner lock clip and locking washer 10 is unitary member that includes a ring portion 72 and a clip portion 74. Ring portion 72 is positioned around external threads 62 of fixture 58 in abutting relationship with stop member 64 via optional catcher 70, which actually contacts stop member 64 by way of locking washer 66. Catcher 70 is preferably primarily in stop contact with locking washer 66 but may also be in stop contact with lip 68. Ring portion 72 may also, in the absence of catcher 70, be in direct contact with stop member 64 at locking washer 66. In such a configuration, liner 50 would be positioned directly abutting the transverse wall of stop member 64 and closely adjoining the inner surface of circumferential lip 68 so that liner 50 is restrained by lip 68. In the configuration shown in FIGS. 1–4, liner 50 is set in the disk of catcher 50.

Both ring portion 72 and clip portion 74 of device 10 are formed of a continuous unitary wire-like member that is preferably circylar in cross-section. The material of device 10 is of resilient. that is, biasable, material.

Ring portion 72 includes a ring element 76 having proximately spaced end portions forming a gap in the continuity of the circle of ring element 76. One end portion has a resiliant finger 78 extending upwards from ring element 76 as seen in FIG. 2 when finger 78 is in an unbiased mode. In the biased mode, finger 78 is pressed down to the plane of ring element 76 by shoulder 42 of bracket 32 during the process of assembling bracket 32 onto fixture 68. Thus, finger 78 is movable between an unbiased position spaced from the plane of ring element 76 and a biased position substantially aligned with the plane of ring element 76. Finger 78 is its assembled, or biased, mode, acts to lock ring portion 72 between bracket shoulder 42 and stop member 64, specifically between ornamental catcher 70 and shoulder 42. Biased finger 78 thus caused outward pressure against shoulder 42 and stop member 64, which action tends to lock internal and external threads 46 and 62 into a tighter cleavage than they would have obtained without the locking washer action of device 10.

Clip portion 74 of device 10 is connected to the other end of ring element 76 proximate to the end from which finger 78 extends. Clip portion 74 comprises a resilient prong 80 having a hooked tip 82 downwardly disposed, that is, disposed towards fixture 58. Prong 80 is movable between an unbiased position wherein hooked top 82 is capable of extending past the outer surface of liner wall 52 and a biased position wherein hooked tip 82 is positioned in approximate alignment with the innersurface of liner wall 52. Slot 56 in liner wall 52 is capable of receiving hooked tip 82 in hooked, or locked, relationship in the unbiased position. FIGS. 2 and 4 show prong 80 in the unbiased mode, with FIG. 2 showing it prior to assembly and FIG. 4 subsequently to assembly. It is noted that in order for prong 80 to be assembled through slot 56, it is necessary for the prong to be pressed back into its biased mode within liner wall 52 as liner 50 is slid downwards into position with fixture 58. As seen in FIG. 4, tip 82 extends past the outer surface of liner wall 52 in the hooked position; in this position, tip 82 can be pressed back from slot 56 into its biased mode thus freeing liner 50 to be slid upwards away form bracket out of its locked relationship with bracket 32 and device 10.

The embodiments of the present invention particularly disclosed herein are presented merely as examples of the invention. Other embodiments, forms, and modifications of this invention coming within the proper scope of the appended claims will, of course, readily suggest themselves to those skilled in the art.

What is claimed is:

1. A liner locking and locking washer system for mounting an incandescent lamp, comprising, in combination:

a socket body for holding said incandescent lamp, electrical conductor means for connecting said incandescent lamp with a source of electrical power, elongated bracket means for holding said socket body at one end and forming a hole provided with internal threads at the opposed end, said bracket means also being for passing said conductor means from said socket body through said hole.

an elongated liner having a cylindrical wall forming a hollow cylinder adapted to be slidingly positioned around said socket body and said elongated bracket means, said outer wall forming a slot proximate to said internal threads, fixture means for mounting said bracket means to a support structure at one end and having external threads at the other end that are matingly connected to said internal threads of said elongated bracket means, said fixture means also being for passing said conductor means from said bracket means to said source of electrical power, said fixture means including stop means positioned proximate to said external threads for preventing said liner from sliding onto said fixture member, and unitary washer and clip means for providing a locking washer between said stop means of said fixture means and for interacting waith said slot of said liner for removably locking said unitary means with said liner and so preventing said liner from sliding away from said fixture means while in a locked mode.

2. A system according to claim 1, wherein said unitary washer and clip means includes a unitary ring and clip member having a ring portion and a clip portion, said ring portion being positioned around said external threads of said fixture means in abutting relationship with said stop means and in pressing connection with said opposed end of said bracket means.

3. A system according to claim 2, wherein said ring portion includes a ring element having proximately spaced end portions, one said end portion having a resilient finger movable between an unbiased position spaced from the place of said ring element and a biased position substantially aligned with the plane of said ring element. said finger being pressed into said biased position by said opposed end of said bracket means against said stop means of said fixture member when said mounting means is threaded onto said fixture member.

4. A system according to claim 3, wherein said resilient finger is positioned biased towards said bracket means in the biased mode.

5. A system according to claim 3, wherein said clip portion of said spaced end portions of said ring element, said clip portion comprises a a resilient prong having a hooked tip disposed toward said fixture means, said prong being movable between an unbiased position wherein said hooked tip is capable of extending past the outer surface of said liner wall and a biased position wherein said hooked tip is positioned with the inner surface of said liner wall, said slot being capable of receiving said hooked tip in locked relationship there between in said unbiased position in said locked mode, said hooked tip being capable of being pressed into said biased position into an unlocked mode whereby said liner can be manually placed around or removed from said bracket means and said socket body.

6. A system according to claim 4, wherein said prong extends towards said socket body in the assembled position.

7. A system according to claim 4, wherein said support structure is a vertical wall, and said fixture means is a tubular member adapted to pass said conductor means to said source of electrical power, said tubular means including a horizontal portion having one end adapted to be mounted to said vertical wall and further including a vertical portion connected to the opposite end of said horizontal portion, said vertical portion being said other end having said external screws.

8. A system according to claim 5, wherein said unitary ring and clip member is a continuous wire-line member that is circular in cross-section.

* * * * *